US005643061A

United States Patent [19]

Jackson et al.

[11] Patent Number: 5,643,061

[45] Date of Patent: Jul. 1, 1997

[54] PNEUMATIC POLISHING HEAD FOR CMP APPARATUS

[75] Inventors: Paul David Jackson, Scottsdale; Stephen Charles Schultz, Gilbert, both of Ariz.

[73] Assignee: Integrated Process Equipment Corporation, Phoenix, Ariz.

[21] Appl. No.: 504,686

[22] Filed: Jul. 20, 1995

[51] Int. Cl.[6] ..... B24B 37/04

[52] U.S. Cl. ..... 451/289; 451/288; 451/398

[58] Field of Search ..... 451/287, 288, 451/290, 385, 388, 398, 41, 364, 289

[56] References Cited

U.S. PATENT DOCUMENTS

| | | | |
|---|---|---|---|
| 4,141,180 | 2/1979 | Gill, Jr. et al. | 51/5 R |
| 4,519,168 | 5/1985 | Cesna | 451/287 |
| 5,205,082 | 4/1993 | Shendon et al. | 51/283 R |
| 5,423,558 | 6/1995 | Koeth et al. | 451/388 |
| 5,527,209 | 6/1996 | Volodarsky et al. | 451/388 |

FOREIGN PATENT DOCUMENTS

| | | | |
|---|---|---|---|
| 4058294 | 5/1979 | Japan | 451/289 |
| 6091522 | 4/1994 | Japan | 451/288 |

*Primary Examiner*—Robert A. Rose

*Attorney, Agent, or Firm*—Cahill, Sutton & Thomas P.L.C.

[57] ABSTRACT

A polishing head for chemical-mechanical polishing apparatus includes a carrier plate having concentric, integral, cylindrical walls, an annular piston fitting within the outer of the cylindrical walls and a second piston fitting within the inner cylindrical wall and engaging the annular piston. Each piston defines a chamber with the carrier plate and the chambers are isolated from each other by a seal. Pneumatic fittings supply air or vacuum to each chamber. The second piston includes a cylindrical side wall and an integral bottom plate. The bottom plate is thicker in the center than at the side wall and the underside of the plate is covered with a wafer adhering layer. A retaining ring is attached to the lower edge of the annular piston. The retaining ring includes a peripheral groove for separating an outwardly extending flange from the main body of the ring. The underside of the ring includes one or more spiral grooves for circulating slurry about a wafer during polishing.

20 Claims, 2 Drawing Sheets

PNEUMATIC POLISHING HEAD FOR CMP APPARATUS

BACKGROUND OF THE INVENTION

This invention relates to chemical-mechanical polishing (CMP) apparatus and, in particular, to a pneumatically actuated polishing head for such apparatus.

CMP apparatus is used primarily for polishing the front face or device side of a semiconductor wafer during the fabrication of semiconductor devices on the wafer. A wafer is "planarized" or smoothed one or more times during the fabrication process in order for the top surface of the wafer to be as flat as possible. A wafer is polished by being placed on a carrier and pressed face down onto a polishing pad covered with a slurry of colloidal silica or alumina in de-ionized water.

A polishing pad is typically constructed in two layers overlying a platen with the less resilient layer as the outer layer of the pad. The layers are typically made of polyurethane and may include a filler for controlling the dimensional stability of the layers. A polishing pad is usually several times the diameter of a wafer and the wafer is kept off center on the pad to prevent polishing a non-planar surface onto the wafer. The wafer is rotated to prevent polishing a taper into the wafer. Although the axis of rotation of the wafer and the axis of rotation of the pad are not collinear, the axes must be parallel.

The platens used for a polishing pad and for a polishing head are carefully machined to produce optically flat, parallel surfaces. The resilient layers on a polishing pad are assumed to provide a uniform pressure on a wafer. It is believed that this assumption is in error and one aspect of the invention addresses the problem of distortion in the polishing pad.

Polishing heads must meet somewhat conflicting requirements for use in CMP apparatus. The wafer must be securely held but not damaged or contaminated. Polishing heads of the prior art typically use a wax-like material to attach the wafer temporarily to the carrier. The wax must be completely removable and must not affect the silicon to which it is attached. The polishing head cannot be so rigid that the wafer is chipped or damaged when the wafer engages the polishing pad or the head.

Gill, Jr. et al. U.S. Pat. No. 4,141,180 discloses a polishing head attached to a vertical shaft by a ball and socket joint to permit limited movement of the head to accommodate variations in the thickness of a wafer. The wafer carrier is covered with a felt-like material and the wafer is held against the nap surface by a vacuum coupled to the back of the wafer through a plurality of holes in the carrier. The polishing head includes a plastic ring encircling the wafer to locate the wafer radially with respect to the vertical shaft.

Shendon et al. U.S. Pat. No. 5,205,082 discloses a polishing head including a flexible diaphragm attached to a wafer carrier and to a retaining ring. Air pressure on one side of the diaphragm is above ambient pressure and air pressure on the wafer side of the diaphragm is at ambient pressure. The pressure on a wafer can be non-uniform due to forces from deflection of the diaphragm itself. Vertical motion of the carrier is limited by a flange engaging an adjustment bolt, which must be loosened to lower the carrier. A "C" washer is described for facilitating this adjustment.

The retaining ring surrounding a wafer in a polishing head of the prior art has an inside diameter slightly larger than the diameter of the wafer and there is always a slight gap between the wafer and the ring. Whether the ring presses against the resilient polishing pad or not, there is inevitably an annular region about the periphery of the wafer where the polishing is not uniform, known in the art as "edge exclusion." Edge exclusion in the prior art is typically 5–10 mm. wide and reduces the area of the wafer from which good die can be obtained.

It is known in the art that uniformity in wafer polishing is a function of pressure, velocity, and the concentration of chemicals. Edge exclusion is caused, in part, by non-uniform pressure on a wafer. The prior art attempts to solve the problem by contacting the polishing pad with the retaining ring, e.g. as disclosed in the Shendon et al. patent, but the problem remains.

Another aspect of the problem of uniformity is the distribution of the slurry. As a wafer is polished, chemical by-products locally change the composition, pH, particle size, and uniformity of the slurry. In the prior art, this problem was addressed by thoroughly mixing the slurry and by controlling the rate of flow to the polishing pad; specifically, by providing a sufficient flow to prevent large, local changes in composition, particle size, or pH. Even so, edge exclusion remains a problem.

In view of the foregoing, it is therefore an object of the invention to provide an improved polishing head for CMP apparatus.

Another object of the invention is to provide a pneumatic polishing head in which concentric pistons locate a wafer vertically and radially.

A further object of the invention is to provide a polishing head in which the ring surrounding a wafer is pressed against the polishing pad with a force independent of the force applied to the wafer.

Another object of the invention is to provide a more uniform pressure across a wafer, particularly at the edge of the wafer.

A further object of the invention is to improve circulation of slurry to minimize non-uniformities in concentration across the surface of a wafer.

Another object of the invention is to provide a wafer polisher that produces smaller edge exclusion than polishers of the prior art.

A further object of the invention is to provide a polishing head that distorts the polishing pad less than polishing heads of the prior art.

Another object of the invention is to provide a retaining ring that assists in circulating slurry across a wafer to minimize local variations in composition or pH.

SUMMARY OF THE INVENTION

The foregoing objects are achieved by this invention in which a polishing head includes a carrier plate having concentric, integral, cylindrical walls, an annular piston fitting within the outer of the cylindrical walls and a second piston fitting within the inner cylindrical wall and engaging the annular piston. Each piston defines a chamber with the carrier plate and the chambers are isolated from each other by a seal. Pneumatic fittings supply air or vacuum to each chamber. The second piston includes a cylindrical side wall and an integral bottom plate. The bottom plate is thicker in the center than at the side wall and the underside of the plate is covered with a wafer adhering layer. A retaining ring is attached to the lower edge of the annular piston. In accordance with another aspect of the invention, the retaining ring includes a peripheral groove for separating an outwardly extending flange from the main body of the ring. In accordance with a further aspect of the invention, the underside of the retaining ring includes one or more spiral grooves for circulating slurry about a wafer during polishing.

BRIEF DESCRIPTION OF THE DRAWINGS

A more complete understanding of the invention can be obtained by considering the following detailed description in conjunction with the accompanying drawings, in which.

DETAILED DESCRIPTION OF THE INVENTION

Figure 1:
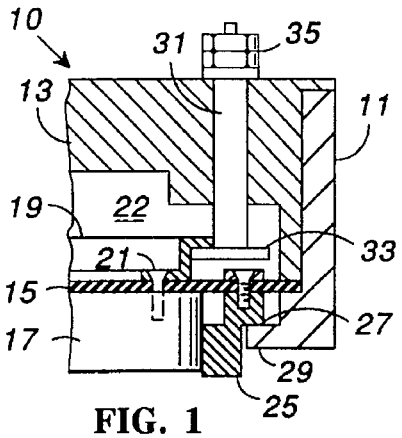
FIG. 1 (PRIOR ART)
FIG. 1 is a cross-section of a portion of a polishing head of the prior art.

FIG. 1 illustrates the right-hand edge portion of a wafer carrier constructed in accordance with the prior art; specifically, in accordance with the Shendon et al. patent. Using the terminology of the Shendon et al patent, carrier 10 includes annular side machined part 11 attached to upper exterior main machined part 13 and trapping flexible but impermeable diaphragm 15 therebetween. Disk-shaped wafer carrier 17 and annular flange ring 19 are located on opposite sides of diaphragm 15 and are connected to each other by several bolts, such as bolt 21. Diaphragm 15 encloses chamber 22 in main machined part 13 and carrier 17 can move vertically, changing the volume of chamber 22.

Retainer 25 surrounds wafer carrier 17 and includes annular projection 27 for engaging inwardly directed annular flange 29 at the lower end of annular side machined part 11. Annular flange 29 provides a lower limit to the motion of retainer 25. Rod 31 extends through machined part 13 and includes stop disk 33 at the lower end thereof. Stop disk 33 engages ring 19 and provides a lower limit to the motion of carrier 17. The lower limit to the motion of carrier 17 is adjustable by loosening nut 35 and adding or removing washers between nut 35 and main machined part 13.

In operation, chamber 22 can be pressurized or evacuated to move retainer 25 and carrier 17. Carrier 17 and retainer 25 are not independently adjustable, except that the lower limit of the travel of carrier 17 can be changed by adjusting the position of stop disk 33. Because carrier 17 and retainer 25 share a common chamber, the pressure on these two elements is always the same, except for any force provided by deformation of diaphragm 15.

Figure 2:
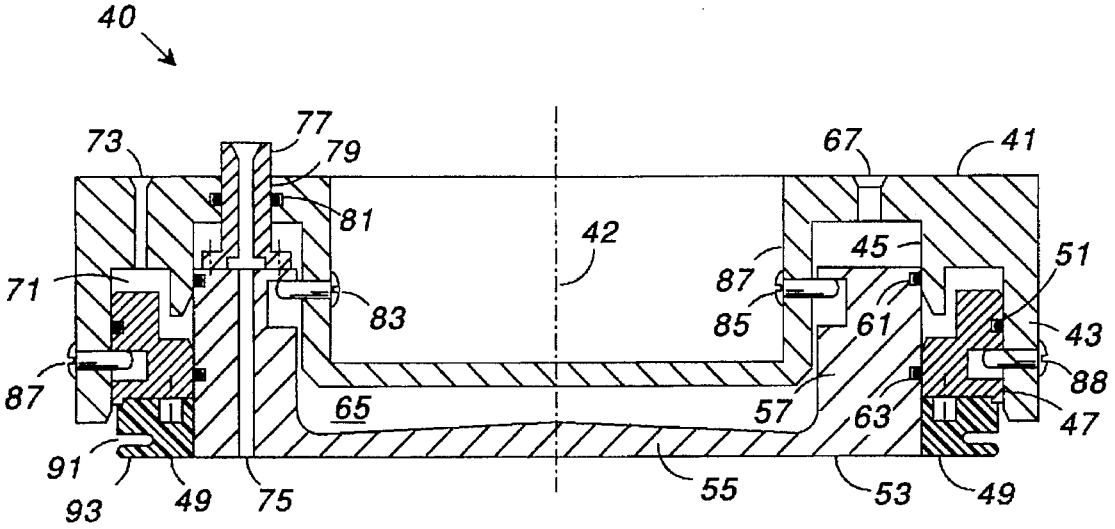
FIG. 2 is a cross-section of a polishing head constructed in accordance with a preferred embodiment of the invention.

FIG. 2 illustrates a polishing head constructed in accordance with a preferred embodiment of the invention. Head 40 includes carrier plate 41 and a pair of concentric pistons, pistons 43 and 45, which rotate together about common axis 42. Carrier plate 41 includes a pair of concentric, integral, cylindrical walls 47 and 48. Piston 43 fits within cylindrical wall 47 and is sealed to the inner surface of the wall by sliding seal 51. Piston 45 engages cylindrical wall 48 at seal 61 and engages piston 43 at seal 63. The pistons can move independently of each other relative to carrier plate 41 in a direction parallel to axis 42. Piston 45 includes bottom plate 55 and integral, cylindrical side wall 57. It is preferred that bottom plate 55 be thicker in the middle than near side wall 57 to prevent bottom plate 55 from flexing when a pressure differential exists across the bottom plate. Retaining ring 49 is attached to the lower edge of piston 43 by a mechanical fastener (not shown).

Piston 45 and carrier plate 41 define chamber 65 which is coupled to a source of compressed air or vacuum by pneumatic fitting 67. Piston 43 and carrier plate 41 define chamber 71, which is coupled to a source of compressed air or vacuum by pneumatic fitting 73. Chambers 65 and 71 are isolated from each other by seal 61 and can be independently pressurized or evacuated. If the pressure in chamber 65 is above ambient pressure, piston 45 will move downwardly in response to the pressure differential.

Piston 45 includes passageway 75 extending vertically through side wall 57. Fitting 77 is attached to the upper surface of side wall 57 and extends through hole 79 in carrier plate 41. Fitting 77 engages sliding seal 81, permitting fitting 77 to move up and down without leakage through hole 79. Air, vacuum, or de-ionized water can be supplied to fitting 77. Water can be used to rinse a wafer prior to picking up the wafer and can be used to pick up a wafer using surface tension, although vacuum pickup is preferred.

Pins 83 and 85 extend through wall 87 of carrier plate 41 to engage slots in the inner surface of side wall 57, thereby limiting the travel of piston 45. Other travel limiting mechanisms could be used instead. Similarly, pins 87 and 88 engage elongated slots in the outside surface of piston 43. Piston 43, and retaining ring 49, move upwardly or downwardly depending upon the pressure within chamber 71 relative to ambient pressure.

Figure 3:
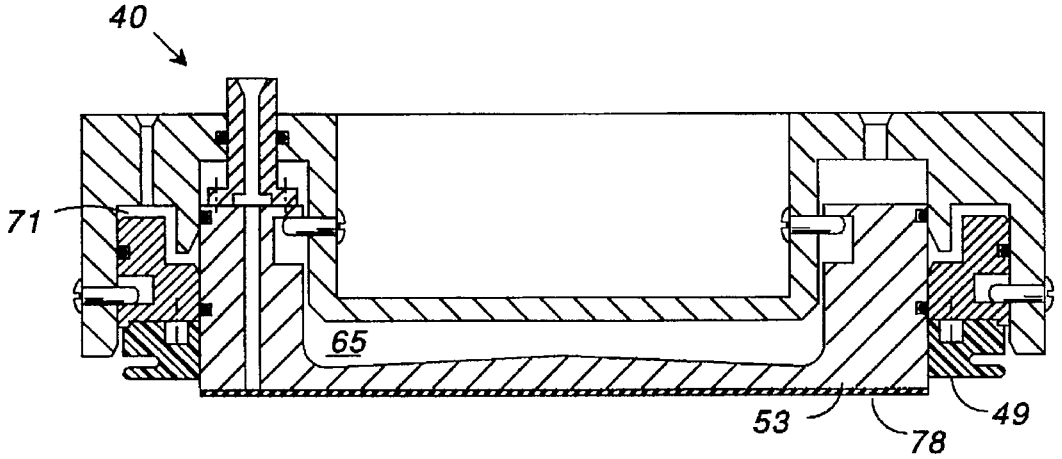
FIG. 3 illustrates extending the wafer piston to facilitate maintenance.

FIG. 3 illustrates head 40 with piston 45 extended to receive wafer adhering layer 78. Unlike the prior art, piston 45 is readily extended by slightly increasing the pressure in chamber 65 above ambient pressure. The pressure in chamber 71 is reduced below ambient pressure, thereby withdrawing retaining ring 49 and exposing the perimeter of piston 45. This configuration greatly facilitates loading and maintaining the polishing head. For example, wafer adhering layer 78 is easily removed and replaced on the bottom surface of piston 45 when the piston is extended.

Wafer adhering layer 78 is preferably a felt-like material having an adhesive backing that secures the layer to piston 45. Layer 78 is porous, enabling a vacuum to be applied through the layer to the backside of a wafer, holding the wafer in place against piston 45. The nap in the outer surface of layer 78 provides frictional engagement with a wafer, enabling polishing head 40 to rotate a wafer against a rotating polishing pad (not shown).

Figure 4:
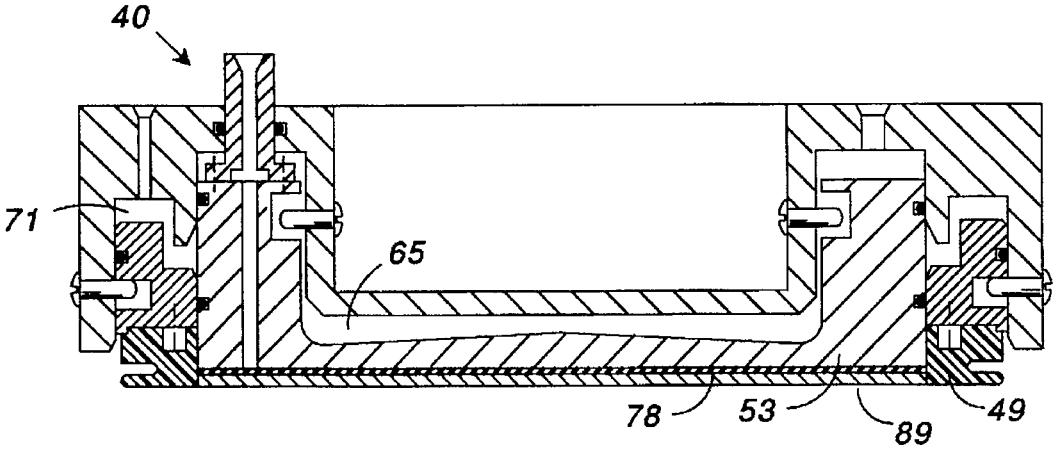
FIG. 4 illustrates extending the wafer retaining ring to be co-planar with the lower surface of a wafer.

In FIG. 4, piston 45 and retaining ring 49 are approximately co-planar and wafer 89 is located within retaining ring 49, ready for polishing. The independently adjustable pistons enable one to apply the proper pressures to wafer 89 and to retaining ring 49. In theory, the pressures should be equal but in practice it has been found that the pressures must be unequal and determined empirically. For example, polishing a wafer having a substantial amount of exposed metal may require different pressures than a wafer having a substantial amount of exposed silicon dioxide, which is softer than a metal layer. Specifically, the retaining ring may be subjected to a slightly greater pressure than the wafer when polishing a wafer having a substantial amount of exposed metal.

Retaining ring 49 is an annular member having a rectangular cross-section, an inside diameter approximately equal to the outside diameter of piston 45, and an outside diameter approximately equal to the outside diameter of piston 43. Retaining ring 49 is preferably made from a relatively hard, chemically inert material such as Delrin® plastic or Tecktron® PPS. Perimeter groove 91 in retaining ring 49 extends from the outside diameter of the ring to a predetermined smaller diameter for separating outwardly extending flange 93 from the body of the retaining ring. Flange 93 provides a more resilient contact to a polishing pad than a solid plastic ring.

Figure 5:
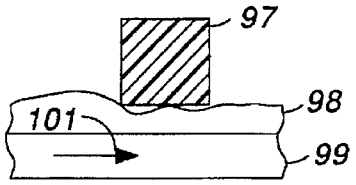
FIG. 5 illustrates the operation of a retaining ring constructed in accordance with the prior art.
Figure 6:
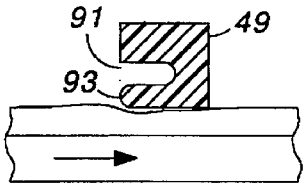
FIG. 6 illustrates the operation of a retaining ring constructed in accordance with a preferred embodiment of the invention.

The operation of flange 93 is illustrated in FIGS. 5 and 6. In FIG. 5, retaining ring 97 engages resilient pad 98 on platen 99. As platen 99 is moved from left to right, as indicated by arrow 101, the leading edge of retaining ring 97 causes a "bow wave" effect and undulations in resilient pad 98. These undulations are pressure variations that can adversely affect polishing a wafer, particularly at the edge of a wafer.

In accordance with the invention, retaining ring 49 includes flange 93 having rounded corners and separated from the body of retaining ring 49 by groove 91. Flange 93 is slightly flexible and provides a damping action to any undulations that may form at the outer edge of retaining ring 49.

Figure 7:
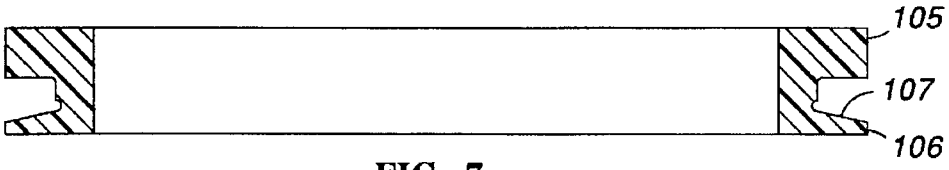
FIG. 7 is a cross-section of an alternative embodiment of a retaining ring.
Figure 8:
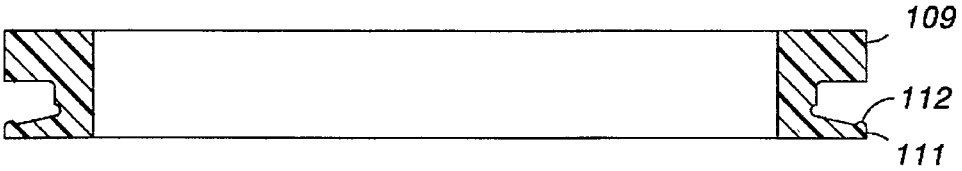
FIG. 8 is a cross-section of an alternative embodiment of a retaining ring.

FIG. 7 illustrates a retaining ring constructed in accordance with an alternative embodiment of the invention. Retaining ring 105 includes flange 106 having taper 107 in which the thickness of flange 106 decreases with increasing diameter. In FIG. 8, retaining ring 109 includes flange 111 having a taper and including outermost edge 112 that is thicker than the portion of the flange interior to the outermost edge. Thickened edge 112 provides a slight stiffening for changing the natural frequency of flange 111 to assure that the flange does not increase rather than reduce undulations in the resilient pad. Thickened edge 112 also improves the machinability of ring 105.

Figure 9:
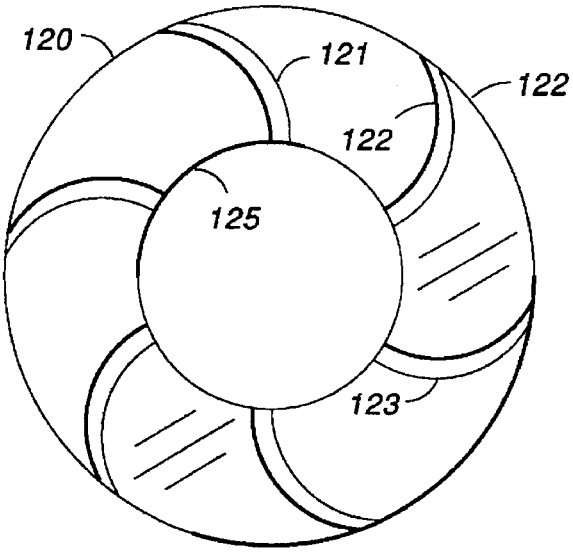
FIG. 9 is a plan view illustrating spiral grooves in the lower surface of a retaining ring constructed in accordance with another aspect of the invention.
Figure 10:
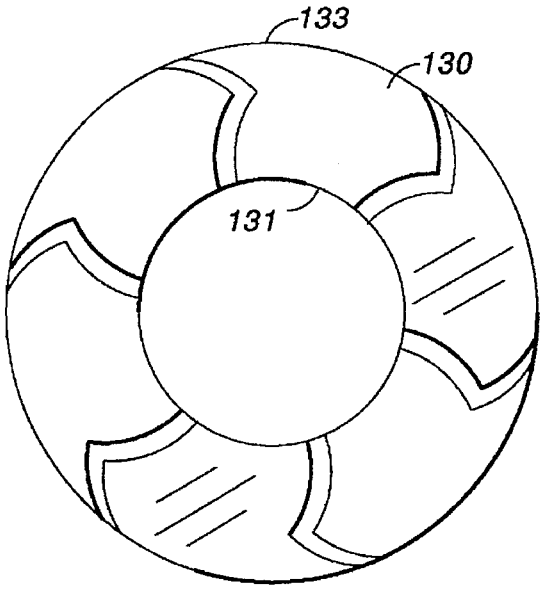
FIG. 10 is a plan view of the lower surface of a retaining ring constructed in accordance with an alternative embodiment of the invention.

FIGS. 9 and 10 illustrates a retaining ring constructed in accordance with another aspect of the invention. It is desirable for the slurry on a polishing pad to have a uniform composition. Retaining ring 120, illustrated with exaggerated width, includes a plurality of spiral grooves, such as grooves 121, 122, and 123, extending from inner edge 125 to outer edge 126 of the retaining ring. As the retaining ring rotates, the grooves in the underside of retaining ring 120 assist in circulating the slurry about a wafer within the ring, assuring a thorough mixing and distribution of the slurry and decreasing the likelihood of inhomogeneities.

Although a single, long, spiral groove could be used, it is preferred that the underside of retaining ring 120 have a plurality of spiral grooves, as illustrated in FIG. 9. The term "spiral" is not intended rigorously. For example, FIG. 10 illustrates an alternative embodiment of the invention in which retaining ring 130 includes a plurality of chevron-shaped spiral grooves extending from inner edge 131 to outer edge 133. Other configurations can be used instead.

The invention thus provides an improved polishing head in which the force applied to a wafer and the force applied to a retaining ring are independently adjustable. The pressure across a wafer is made more uniform by minimizing undulations or ripples in the resilient polishing pads. The uniformity of the polishing is further enhanced by improving the circulation of slurry about the face of the polishing pad. The combination of the independently adjustable pistons and the flange in the retaining ring has been found to reduce edge exclusion from 5–10 mm. to 1–2 mm. on 200 mm., oxide coated test wafers. The concentric pistons also facilitate maintaining the polishing head.

Having thus described the invention, it will be apparent to those of skill in the art that various modifications can be made within the scope of the invention. For example, one can vary the height of the inner and outer cylindrical walls and the heights of the side walls of the pistons. One could use a wax-type coating instead of wafer adhering layer 78. The term "air" is used for the sake of convenience, any compressed gas or mixture of gases can be used to drive the pistons. A liquid, e.g. de-ionized water, can be used instead of air. The term "ambient pressure" is intended as generic for either atmospheric pressure, nominally 760 millibars, or, if the polishing apparatus is operated in a locally controlled atmosphere, such as in a clean room, then "ambient pressure" refers to the pressure of the local atmosphere. Piston 45 could include reinforcing ribs instead of a thickened central area for stiffening bottom plate 55.

What is claimed as the invention is:

1. Chemical-mechanical polishing apparatus including a slurry coated polishing pad and a polishing head for receiving a semiconductor wafer and for holding the wafer against the polishing pad, wherein said polishing head comprises:

a carrier plate having an inner cylindrical wall and an outer cylindrical wall, said walls being concentric and having a common axis;

a first piston fitting within and engaging said outer cylindrical wall and defining a first chamber between said carrier plate and said first piston, said first piston movable in a direction parallel to said axis and having a lower edge;

a second piston fitting within and engaging said inner cylindrical wall, said second piston movable in a direction parallel to said axis and defining a second chamber, separate from said first chamber;

a retaining ring attached to the lower edge of said first piston and surrounding said second piston;

a first pneumatic fitting for coupling said first chamber to a source of air or vacuum;

a second pneumatic fitting for coupling said second chamber to a source of air or vacuum;

whereby said first piston and said second piston are independently movable and can press a wafer against the polishing pad with a force independent of the force applied to said retaining ring.

2. The chemical-mechanical polishing apparatus as set forth in claim 1 wherein said second piston includes an integral cylindrical side wall and bottom plate, wherein the lower surface of said bottom plate is planar and said side wall includes at least one passageway extending through said bottom plate.

3. The chemical-mechanical polishing apparatus as set forth in claim 2 and further including a third pneumatic fitting attached to said second piston for coupling said passageway to a source of air or vacuum.

4. The chemical-mechanical polishing apparatus as set forth in claim 3 wherein said carrier plate includes a hole and a sliding seal within said hole for engaging said third pneumatic fitting and permitting said third pneumatic fitting to move in and out through said hole.

5. The chemical-mechanical polishing apparatus as set forth in claim 2 wherein said bottom plate is stiffened to prevent the bottom plate from flexing when a pressure differential exists across the bottom plate.

6. The chemical-mechanical polishing apparatus as set forth in claim 1 wherein said retaining ring includes a flange for resiliently engaging said polishing pad.

7. The chemical-mechanical polishing apparatus as set forth in claim 6 wherein said flange is tapered, decreasing in thickness with increasing diameter.

8. The chemical-mechanical polishing apparatus as set forth in claim 7 wherein said flange includes an outermost edge thicker than a portion of the flange interior to said outermost edge.

9. The chemical-mechanical polishing apparatus as set forth in claim 1 wherein said retaining ring has a lower surface for engaging said polishing pad and has a groove in said lower surface for circulating slurry about said polishing pad.

10. The chemical-mechanical polishing apparatus as set forth in claim 9 wherein said retaining ring has a plurality of grooves in said lower surface.

11. The chemical-mechanical polishing apparatus as set forth in claim 9 wherein said groove is a spiral.

12. A retaining ring for encircling a semiconductor wafer in chemical-mechanical polishing apparatus and for radially locating said wafer in said apparatus, said retaining ring comprising:

an annular member having a rectangular cross-section of predetermined width between an inside diameter and an outside diameter and a first thickness between an upper surface and a lower surface;

an annular groove in the outside diameter of said member, said annular groove having a diameter less than said outer diameter and greater than said inner diameter and producing a flange having a second thickness between said lower surface and said annular groove.

13. The retaining ring as set forth in claim 12 wherein said flange is tapered.

14. The retaining ring as set forth in claim 13 wherein said flange decreases in thickness with increasing diameter.

15. The retaining ring as set forth in claim 13 wherein said flange includes an outermost edge that is thicker than a portion of the flange interior to said outermost edge.

16. The retaining ring as set forth in claim 12 wherein said lower surface includes a spiral groove for circulating slurry about a polishing pad in said chemical-mechanical polishing apparatus.

17. The retaining ring as set forth in claim 16 wherein said retaining ring has a plurality of spiral grooves in said lower surface.

18. Chemical-mechanical polishing apparatus having a polishing pad and a polishing head for receiving a semiconductor wafer and for holding the wafer against the polishing pad, wherein said polishing head comprises:

a first piston having a planar surface;

a wafer adhering layer on said planar surface;

a retaining ring encircling said first piston;

a second piston coupled to said retaining ring for moving said retaining ring relative to said first piston;

wherein said first piston and said second piston are independently movable for pressing a wafer against the polishing pad with a force independent of the force applied to said retaining ring.

19. The chemical-mechanical polishing apparatus as set forth in claim 18 wherein said second piston includes an integral cylindrical side wall and bottom plate, wherein said bottom plate includes said planar surface and said bottom plate is thicker in the middle than near said side wall to prevent the bottom plate from flexing when a pressure differential exists across the bottom plate.

20. The chemical-mechanical polishing apparatus as set forth in claim 18 wherein said retaining ring includes a flange for resiliently engaging said polishing pad.

* * * * *